US008130977B2

(12) United States Patent
Chu

(10) Patent No.: US 8,130,977 B2
(45) Date of Patent: Mar. 6, 2012

(54) CLUSTER OF FIRST-ORDER MICROPHONES AND METHOD OF OPERATION FOR STEREO INPUT OF VIDEOCONFERENCING SYSTEM

(75) Inventor: Peter L. Chu, Lexington, MA (US)

(73) Assignee: Polycom, Inc., Pleasanton, CA (US)

( * ) Notice: Subject to any disclaimer, the term of this patent is extended or adjusted under 35 U.S.C. 154(b) by 1771 days.

(21) Appl. No.: 11/320,323

(22) Filed: Dec. 27, 2005

(65) Prior Publication Data

US 2007/0147634 A1 Jun. 28, 2007

(51) Int. Cl.

| | |
|---|---|
| ***H04R 3/00*** | (2006.01) |
| ***H04R 1/02*** | (2006.01) |
| ***H04R 29/00*** | (2006.01) |
| ***H04R 5/00*** | (2006.01) |

(52) U.S. Cl. ..... 381/92; 381/91; 381/111; 381/122; 381/56; 381/58; 381/1; 381/17

(58) Field of Classification Search ..... 381/91, 381/922, 111, 122, 92, 56, 58, 310, 77, 80, 381/1, 17; 704/211, E19.005

See application file for complete search history.

(56) References Cited

U.S. PATENT DOCUMENTS

| | | | | |
|---|---|---|---|---|
| 3,755,625 | A | 8/1973 | Maston | |
| 3,824,342 | A | 7/1974 | Christensen et al. | |
| 4,042,779 | A | 8/1977 | Craven et al. | |
| 4,421,957 | A | 12/1983 | Wallace, Jr. | |
| 4,751,738 | A | 6/1988 | Widrow et al. | |
| 4,961,211 | A | 10/1990 | Tsugane et al. | |
| 5,422,956 | A | 6/1995 | Wheaton | |
| 5,778,082 | A | 7/1998 | Chu et al. | |
| 6,021,206 | A | 2/2000 | McGrath | |
| 6,041,127 | A | 3/2000 | Elko | |
| 6,173,059 | B1 * | 1/2001 | Huang et al. | 381/92 |
| 6,259,795 | B1 * | 7/2001 | McGrath | 381/310 |
| 6,668,062 | B1 | 12/2003 | Luo et al. | |
| 6,783,059 | B2 | 8/2004 | Laskaris et al. | |
| 6,788,337 | B1 | 9/2004 | Fuji | |
| 6,836,243 | B2 * | 12/2004 | Kajala et al. | 342/377 |
| 6,922,206 | B2 | 7/2005 | Chu et al. | |
| 6,983,055 | B2 | 1/2006 | Luo | |
| 7,123,727 | B2 | 10/2006 | Elko et al. | |
| 7,130,705 | B2 | 10/2006 | Amir et al. | |

(Continued)

OTHER PUBLICATIONS

Office Action mailed Dec. 24, 2008 from U.S. Appl. No. 11/095,900, which issued as US Pat. No. 7,646,876.

(Continued)

*Primary Examiner* — Devona Faulk

(74) *Attorney, Agent, or Firm* — Wong, Cabello, Lutsch, Rutherford & Brucculeri, LLP

(57) ABSTRACT

An arbitrarily positioned cluster of three microphones can be used for stereo input of a videoconferencing system. To produce stereo input, right and left weightings for signal inputs from each of the microphones are determined. The right and left weightings correspond to preferred directive patterns for stereo input of the system. The determined right weightings are applied to the signal inputs from each of the microphones, and the weighted inputs are summed to product the right input. The same is done for the left input using the determined left weightings. The three microphones are preferably first-order, cardioid microphone capsules spaced close together in an audio unit, where each faces radially outward at 120-degrees. The orientation of the arbitrarily positioned cluster relative to the system can be determined by directly detecting the orientation or by using stored arrangements.

24 Claims, 9 Drawing Sheets

U.S. PATENT DOCUMENTS

| | | | | |
|---|---|---|---|---|
| 7,206,421 | B1 | 4/2007 | Taenzer | |
| 7,333,622 | B2 | 2/2008 | Algazi et al. | |
| 7,460,677 | B1 | 12/2008 | Soede et al. | |
| 7,646,876 | B2 * | 1/2010 | Chu et al. | 381/92 |
| 7,817,806 | B2 | 10/2010 | Nakano | |
| 2003/0031334 | A1 | 2/2003 | Layton et al. | |
| 2004/0263636 | A1 | 12/2004 | Cutler | |
| 2005/0008169 | A1 * | 1/2005 | Muren et al. | 381/92 |
| 2005/0058300 | A1 | 3/2005 | Suzuki et al. | |
| 2007/0064925 | A1 | 3/2007 | Suzuki et al. | |

OTHER PUBLICATIONS

Response to Office Action mailed Dec. 24, 2008 from U.S. Appl. No. 11/095,900, which issued as US Pat. No. 7,646,876.

Final Office Action mailed May 20, 2009 from U.S. Appl. No. 11/095,900, which issued as US Pat. No. 7,646,876.

Response to Final Office Action mailed May 20, 2009 from U.S. Appl. No. 11/095,900, which issued as US Pat. No. 7,646,876.

Notice of Allowance mailed Sep. 4, 2009 from U.S. Appl. No. 11/095,900, which issued as US Pat. No. 7,646,876.

Cotterell, Philip, "On the Theory of the Second-Order Soundfield Microphone," dated Feb. 2002, Index and Chapter 5, pp. 1-5 and 92-107.

Elko, Gary W., "A Simple Adaptive First-Order Differential Microphone," undated, obtained from http://www.darpa.mil/MTO/sono/presentations/lucentelko.pdf, pp. 1-10.

Thompson, Stephen C., "Directional Patterns Obtained from Two or Three Microphones," dated Sep. 29, 2000, pp. 1-10.

* cited by examiner

CLUSTER OF FIRST-ORDER MICROPHONES AND METHOD OF OPERATION FOR STEREO INPUT OF VIDEOCONFERENCING SYSTEM

FIELD OF THE DISCLOSURE

The subject matter of the present disclosure generally relates to microphones for multi-channel input of an audio system and, more particularly, relates to a cluster of at least three, first-order microphones for stereo input of a videoconferencing system.

BACKGROUND OF THE DISCLOSURE

Microphone pods are known in the art and are used in videoconferencing and other applications. Commercially available examples of prior art microphone pods are used with VSX videoconferencing systems from Polycom, Inc., the assignee of the present disclosure.

One such prior art microphone pod 10 is illustrated in a plan view of FIG. 1. The pod 10 has three microphones 12A-C housed in a body 14. Such a microphone pod 10 can be used in audio and video conferences. In situations where there are many participants or a large conference, multiple pods are used together because it is preferred that the participants be no more than about 3 to 4 feet away from a microphone.

Videoconferencing is preferably operated in stereo so that sources of sound (e.g., participants) during the conference will match the location of those sources captured by the camera of a videoconferencing system. However, the prior art pod 10 has historically been operated for mono input of a videoconferencing system. For example, the pod 10 is positioned on a table where the videoconference is being held, and the microphones 12A-C pickup sound from the various sound sources around the pod 10. Then, the sound obtained by the microphones 12A-C is combined together and used as mono input to other parts of the videoconferencing system.

Therefore, what is needed is a cluster of microphones that can be used for stereo input of a videoconferencing system. The subject matter of the present disclosure is directed to overcoming, or at least reducing the effects of, one or more of the problems set forth above.

SUMMARY OF THE DISCLOSURE

An arbitrarily positioned cluster of at least three microphones can be used for stereo input of a videoconferencing system. To produce stereo input, right and left weightings for signal inputs from each of the microphones are determined. The right and left weightings correspond to preferred directive patterns for stereo input of the system. The determined right weightings are applied to the signal inputs from each of the microphones, and the weighted inputs are summed to product the right input. The same is done for the left input using the determined left weightings. The three microphones are preferably first-order, cardioid microphones spaced close together in an audio unit, where each faces radially outward at 120-degrees. The orientation of the arbitrarily positioned cluster relative to the system can be determined by directly detecting the orientation with a detection sequence or by using a calibration sequence having stored arrangements.

The foregoing summary is not intended to summarize each potential embodiment or every aspect of the present disclosure.

BRIEF DESCRIPTION OF THE DRAWINGS

The foregoing summary, preferred embodiments, and other aspects of the subject matter of the present disclosure will be best understood with reference to a detailed description of specific embodiments, which follows, when read in conjunction with the accompanying drawings, in which.

Figure 1:
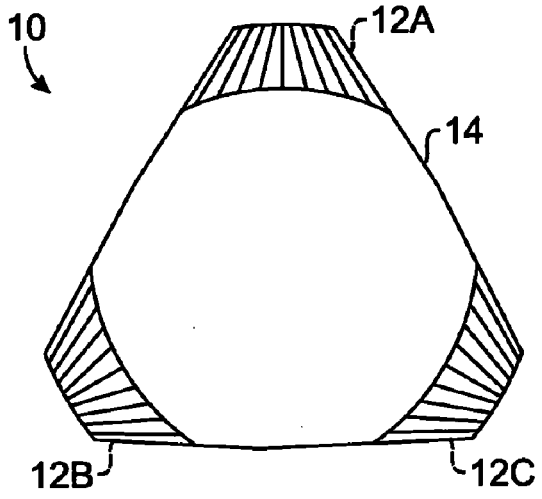
FIG. 1 (Prior Art)
FIG. 1 illustrates a microphone pod according to the prior art.

While the disclosed audio unit and its method of operation for stereo input of an audio system are susceptible to various modifications and alternative forms, specific embodiments thereof have been shown by way of example in the drawings and are herein described in detail. The figures and written description are not intended to limit the scope of the inventive concepts in any manner. Rather, the figures and written description are provided to illustrate the inventive concepts to a person skilled in the art by reference to particular embodiments, as required by 35 U.S.C. §112.

DETAILED DESCRIPTION

Figure 2:
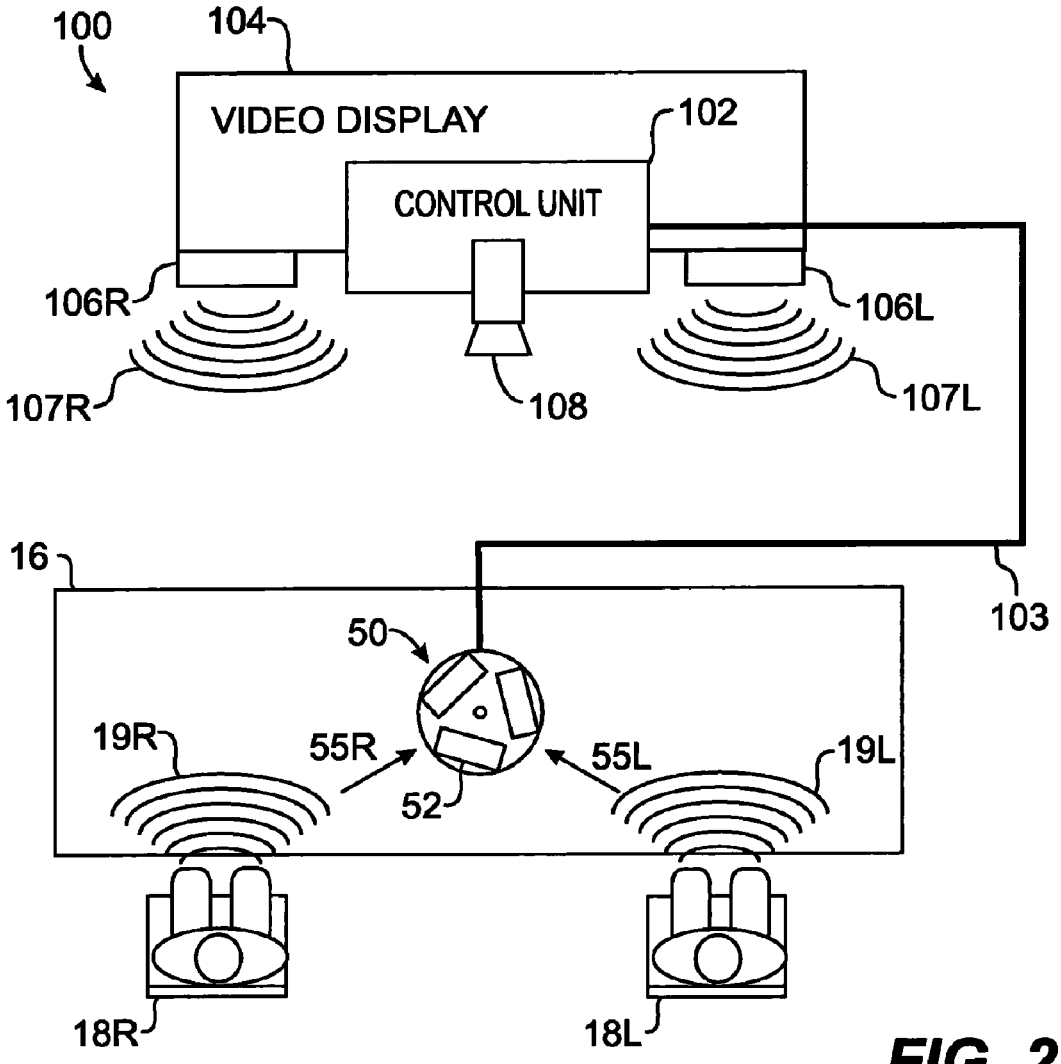
FIG. 2 illustrates a videoconferencing system having an audio unit with a cluster of microphones according to certain teachings of the present disclosure.

Referring to FIG. 2, a video conferencing system 100 having an audio unit 50 is illustrated. Although FIG. 2 focuses on the use of the disclosed audio unit 50 with videoconferencing system 100, the audio unit 50 can also be used for multi-channel audio conferencing, recording systems, and other applications.

The videoconferencing system 100 includes a control unit 102, a video display 104, stereo speakers 106R-L, and a camera 108, all of which are known in the art and are not detailed herein. The audio unit 50 has at least three microphones 52 operatively coupled to the control unit 102 by a cable 103 or the like. As is common, the audio unit 50 is placed arbitrarily on a table 16 in a conference room and is used to obtain audio (e.g., speech) 19 from participants 18 of the video conference.

The videoconferencing system 100 preferably operates in stereo so that the video of the participants 18 captured by the camera 108 roughly matches the location (i.e., right or left stereo input) of the sound 19 from the participants 18. Therefore, the audio unit 50 preferably operates like a stereo microphone in this context, even though it has three microphones 52 and can be arbitrarily positioned relative to the camera 106. To operate for stereo, the audio unit 50 is configured to have right and left directive patterns, shown here schematically as arrow 55L and 55R for stereo input.

The directive patterns 55L and 55R preferably correspond to (i.e., are on right and left sides relative to) the left and right sides of the view angle of the camera 108 of the videoconferencing system 100 to which the audio unit 50 is associated. With the directive patterns 55L and 55R corresponding to the orientation of the camera 108, speech 19R from a speaker 18R on the right is proportionately captured by the microphones 52 to produce right stereo input for the videoconferencing system 100. Likewise, speech 19L from a speaker 18L on the left is proportionately captured by the microphones 52 to produce left stereo input for the videoconferencing system 100. As discussed in more detail below, having the directive patterns 55L and 55R correspond to the orientation of the camera 108 requires a weighting of the signal inputs from each of the three microphones 52 of the audio unit 50.

Now that the context of the stereo operation of the audio unit 50 has been described, the present disclosure discusses further features of the audio unit 50 and discusses how the control unit 102 configures the audio unit 50 for stereo operation.

Figure 3A:
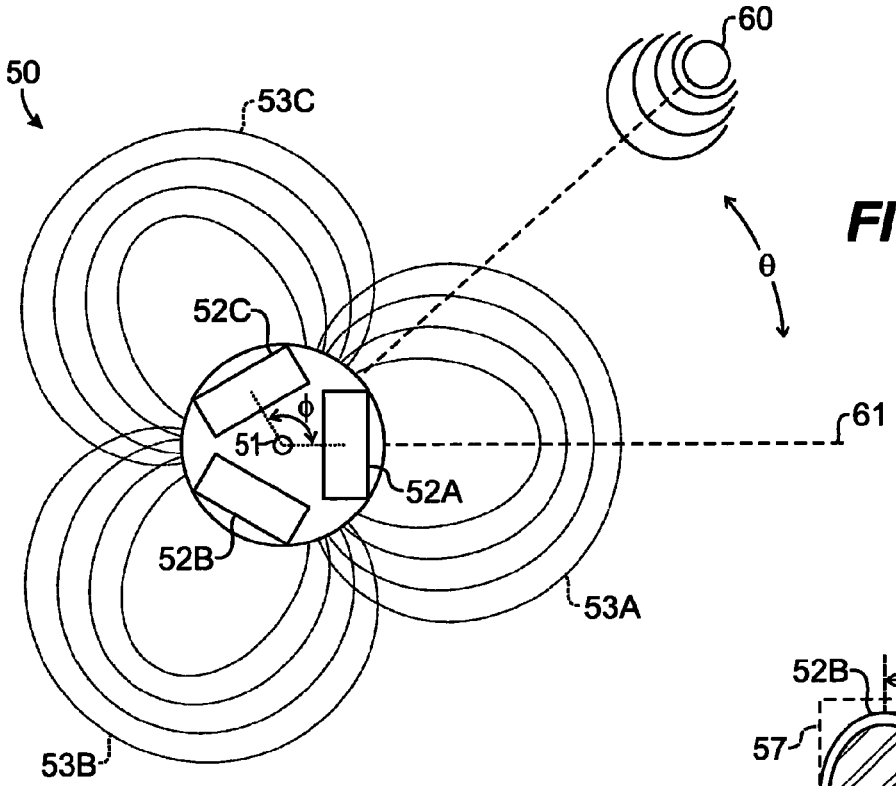
FIGS. 3A-3B illustrate additional features of the disclosed audio unit.
Figure 3B:
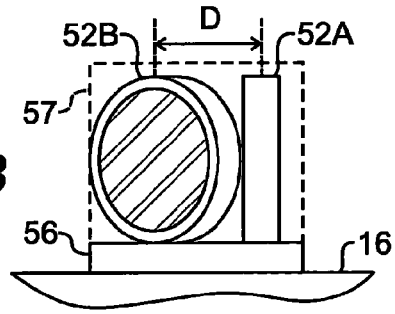

Referring to FIGS. 3A-3B, the audio unit 50 is illustrated in a plan view and a side view, respectively. The audio unit 50 preferably includes at least three microphones 52A-C. Each of the microphones 52A-C is an $N^{th}$-order microphone where $N \geqq 1$. Preferably, each microphone 52A-C is a first-order microphone, although they could be second-order or higher.

The three microphones 52A-C of the audio unit 50 are arranged about a center 51 of the unit 50 to form a microphone cluster, and each microphone 52A-C is mounted to point radially outward from the center 51. In the side view of FIG. 3B, the audio unit 50 can have a housing 57 and a base 56 that positions on a surface 16, such as a table in a conference room. Each microphone 52A-C points substantially outward on a plane parallel to the surface 16.

Figure 3C:
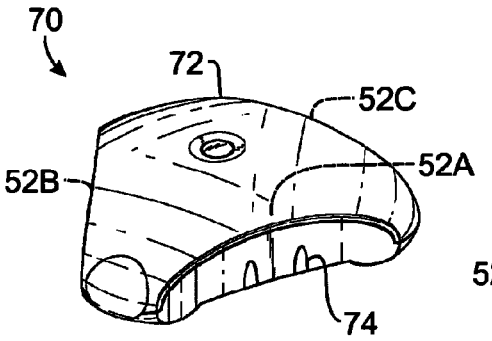
FIG. 3C illustrates a microphone pod having the disclosed audio unit.
Figure 3D:
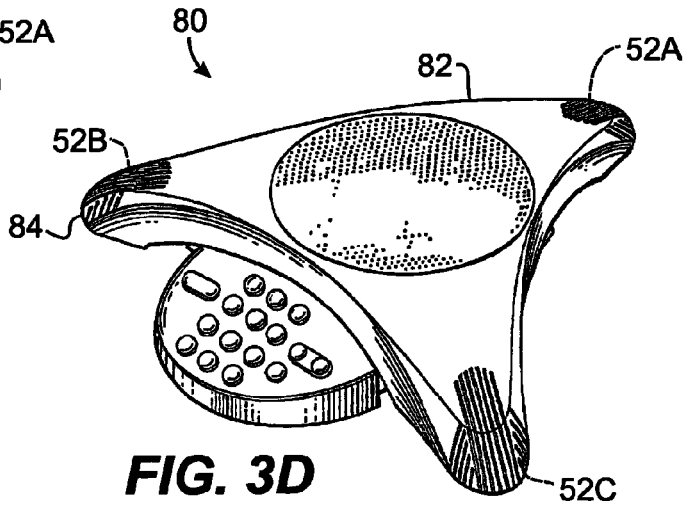
FIG. 3D illustrates a conference phone having the disclosed audio unit.

As shown in FIG. 3C, the cluster of microphones 52A-C for the disclosed audio unit can be part of or incorporated into a stand-alone microphone module or pod 70, which can be used in conjunction with a videoconferencing system, a multi-channel audio conferencing system, or a recording system, for example. The pod 70 has a housing 72 for the microphones 52A-C and can have audio ports 74 for the microphones 52A-C. As shown in FIG. 3D, the cluster of microphones 52A-C for the disclosed audio unit can be part of or incorporated into a conference phone 80, which can be used with a videoconferencing system or a multi-channel audio conferencing system, for example. The conference phone 80 similarly has a housing 82 for the microphones 52A-C and can have audio ports 84 for the microphones 52A-C.

Each microphone 52A-C of the audio unit 50 can be independently characterized by a first-order microphone pattern. For illustrative purposes, the patterns 53A-C are shown in FIG. 3A as cardioid. Thus, each first-order microphone pattern 53A-C for the microphone 52A-C can be generally characterized by the equation:

$$M(\theta)=\alpha+(1-\alpha)*\cos(\theta) \quad (1)$$

where the value of $\alpha$ ($0 \leqq \alpha < 1$) specifies whether the pattern of the microphone is a cardioid, hypercardioid, dipole, etc., where $\theta$ (theta) is the angle of an audio source 60 relative to the microphone (such as microphone 52A in FIG. 3A), and where $M(\theta)$ is the resulting magnitude response of the microphone to the audio source 60.

As $\alpha$ varies in value, different well-known directional patterns occur. For example, a dipole pattern (e.g., figure-of-eight pattern) occurs when $\alpha=0$. A cardioid pattern (e.g., unidirectional pattern) occurs when $\alpha=0.5$. Finally, a hypercardioid pattern (e.g., three lobed pattern) occurs when $\alpha=0.25$.

Because the audio unit 50 has the microphone 52A-C and the unit 50 can be arbitrarily oriented relative to the audio source 60, a second offset angle $\phi$ (phi) is added to equation (1) to specify the orientation of a microphone relative to the source 60. The resulting equation is:

$$M(\theta)=\alpha+(1-\alpha)*\cos(\theta+\phi) \quad (2)$$

For the audio unit 50 of FIGS. 3A-3B, the three microphones 52A-C each point outwardly and radially from the center 51 at 120-degrees ($2\pi/3$ radians) apart. In addition, each microphone 52A-C can be characterized by a cardioid pattern 53A-C (i.e., $\alpha=0.5$). Thus, the three microphones 52A-C of FIG. 3A in this arrangement can each be respectively characterized by the following equations:

$$M(\theta)_A = 0.5 + 0.5\cos(\theta) \text{ for cardioid microphone } 52A \quad (3)$$

$$M(\theta)_B = 0.5 + 0.5\cos\left(\theta - \frac{2\pi}{3}\right) \text{ for cardioid microphone } 52B \quad (4)$$

$$M(\theta)_C = 0.5 + 0.5\cos\left(\theta + \frac{2\pi}{3}\right) \text{ for cardioid microphone } 52C \quad (5)$$

If the angle $\theta$ is zero radians in the equations (3) though (5), then the audio source 60 would essentially be on-axis (i.e., line 61) to the cardioid microphone 52A. Based on the trigonometric identity that $\cos(\theta+\phi)=\cos(\phi)\cos(\theta)-\sin(\phi)\sin(\theta)$, equations (4) and (5) can be then characterized by the following.

For cardioid microphone 52B, the equation is:

$$M(\theta)_B = 0.5 + 0.5\cos\left(\frac{2\pi}{3}\right)\cos(\theta) - 0.5\sin\left(\frac{2\pi}{3}\right)\sin(\theta) \quad (6)$$

For cardioid microphone 52C, the equation is:

$$M(\theta)_C = 0.5 + 0.5\cos\left(-\frac{2\pi}{3}\right)\cos(\theta) - 0.5\sin\left(-\frac{2\pi}{3}\right)\sin(\theta) \quad (7)$$

To configure operation of the audio unit 50 for multi-channel input (e.g., right and left stereo input) of a videoconferencing system, it is preferred that the response of the three, cardioid microphones 52A-C resembles the response of a "hypothetical," first-order microphone characterized by equation (2). Applying the same trigonometric identity as before, equation (2) for such a "hypothetical," first-order microphone can be rewritten as:

$$M(\theta)_H=\alpha+(1-\alpha)\cos(\phi)\cos(\theta)-(1-\alpha)\sin(\phi)\sin(\theta) \quad (8)$$

where $\phi$ in this equation represents the angle of rotation (orientation) of the directive pattern of the "hypothetical" microphone and the value of $\alpha$ specifies whether the directive pattern is cardioid, hypercardioid, dipole, etc.

Finally, unknown weighting variables A, B, and C are respectively applied to the signal inputs of the three microphones 52A-C, and equations (3), (6), (7), and (8) are combined to create three equations: $A \cdot M(\theta)_A = M(\theta)_H$; $B \cdot M(\theta)_B = M(\theta)_H$; and $C \cdot M(\theta)_C = M(\theta)_H$. These three equations are then solved for the unknown weighting variables A, B, and C by first equating the constant terms, then by equating the cos(θ) terms, and finally equating the sin(θ) terms. The resulting equation is:

$$\begin{bmatrix} 1 & 1 & 1 \\ 1 & \cos\left(\frac{2\pi}{3}\right) & \cos\left(-\frac{2\pi}{3}\right) \\ 0 & \sin\left(\frac{2\pi}{3}\right) & \sin\left(-\frac{2\pi}{3}\right) \end{bmatrix} \begin{bmatrix} A \\ B \\ C \end{bmatrix} = \begin{bmatrix} 2\alpha \\ 2(1-\alpha)\cos(\phi) \\ 2(1-\alpha)\sin(\phi) \end{bmatrix} \tag{9}$$

In equation (9), the top row of the 3×3 matrix corresponds to the equated weighting values (A, B, and C). The second row corresponds to the equated cos(θ) terms, and the bottom row corresponds to the equated sin(θ) terms.

If the 3×3 matrix in equation (9) is invertible, then the unknown weighting variables A, B, and C can be found for an arbitrary α (which determines whether the resultant pattern is cardioid, dipole, etc.) and for an arbitrary rotation angle θ.

For equation (9), the inverse of the 3×3 matrix is calculable, and the unknown weighting variables A, B, and C can be explicitly solved for as follows:

$$\begin{bmatrix} A \\ B \\ C \end{bmatrix} = \begin{bmatrix} 0.3333 & 0.6667 & 0 \\ 0.3333 & -0.3333 & -0.5774 \\ 0.3333 & -0.3333 & -0.5774 \end{bmatrix} \begin{bmatrix} 2\alpha \\ 2(1-\alpha)\cos(\phi) \\ 2(1-\alpha)\sin(\phi) \end{bmatrix} \tag{10}$$

Equation (10) is used to find the weighting variables A, B, and C for the signal inputs from the microphones 52A-C of the audio unit 50 so that the response of the audio unit 50 resembles the response of one arbitrarily rotated first-order microphone. To configure the audio unit 50 for stereo operation, equation (10) is solved to find two sets of weightings variables, one set $A_R$, $B_R$, and $C_R$ for right input and one set $A_L$, $B_L$, and $C_L$ for left input. Both sets of weighting variables $A_{R-L}$, $B_{R-L}$, and $C_{R-L}$ are then applied to the signal inputs of the microphones 52A-C so that the response of the audio unit 50 resembles the responses of two arbitrarily-rotated, first-order microphones, one for right stereo input and one for left stereo input.

Figure 4A:
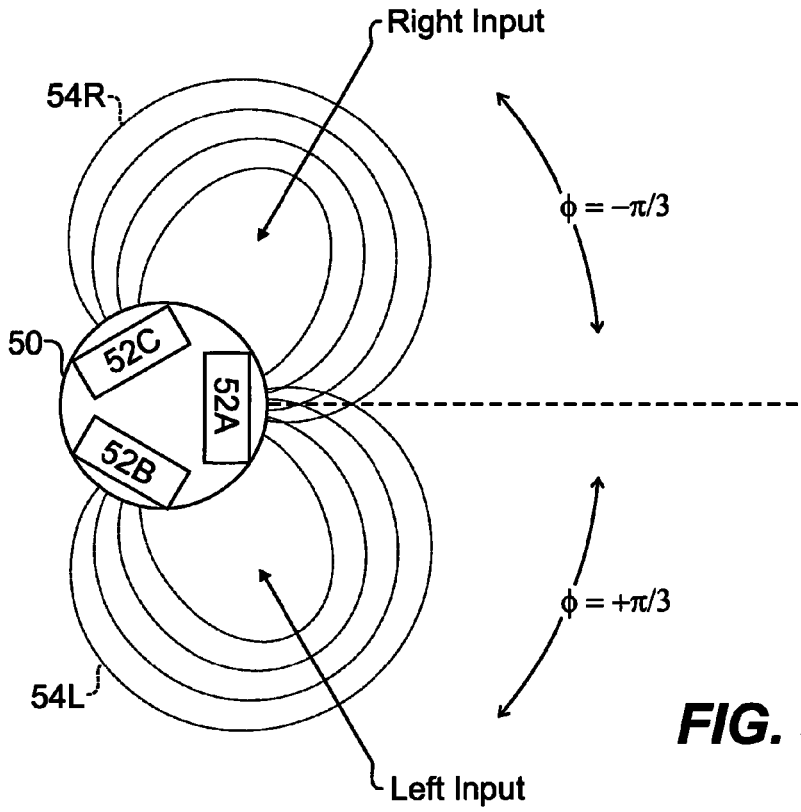
FIG. 4A illustrates the disclosed audio unit configured for stereo input.

For example, as shown in FIG. 4A, equation (10) can be used to configure the audio unit 50 as if it has one directive pattern 54R for right stereo input and another directive pattern 54L for left stereo input. The right and left inputs are formed by weighting the signal inputs of the microphones 52A-C with the sets of weighting variables $A_{R-L}$, $B_{R-L}$, and $C_{R-L}$ determined by equation (10) and summing those weighted signal inputs. Thus, to configure "left" input for the audio unit 50 as if it had a first cardioid (α=0.5) microphone pointing "left" at a rotation of φ=π/3, the "left" weighting variables $A_L$, $B_L$, and $C_L$ for the three actual microphones 52A-C of the audio unit 50 are:

$$A_L=0.6667,\ B_L=0.6667,\ C_L=-0.3333 \tag{11}$$

To configure "right" input for the audio unit 50 as if it had a second cardioid microphone pointing "right" at rotation of φ=−π/3, the "right" weighting variables $A_R$, $B_R$, and $C_R$ for the three actual microphones 52A-C are:

$$A_R=0.6667,\ B_R=-0.3333,\ C_R=0.6667 \tag{12}$$

During operation of the audio unit 50 in a videoconference, the control unit 102 applies these sets of weighting variables $A_{R-L}$, $B_{R-L}$, and $C_{R-L}$ to the signal inputs from the three microphones 52A-C to produce right and left stereo inputs, as if the audio unit 50 had two, first-order microphones having cardioid patterns.

Figure 4B:
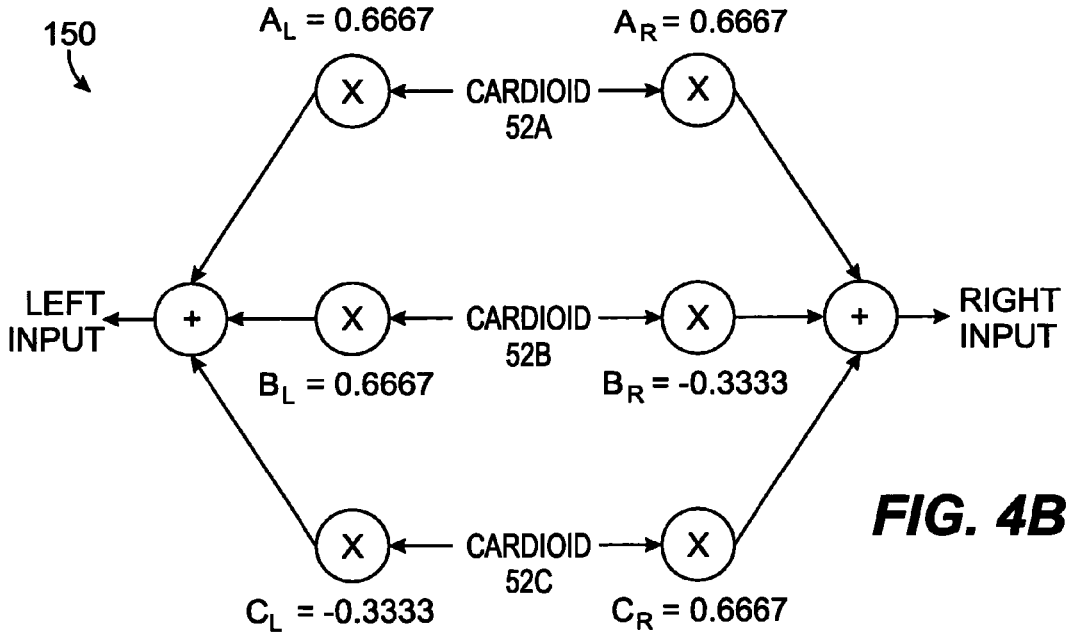
FIG. 4B illustrates an example of stereo operation of the disclosed audio unit.

In FIG. 4B, for example, diagram 150 shows how the signal inputs of the three cardioid microphones 52A-C of the audio unit 50 are weighted by the weighting variables $A_{R-L}$, $B_{R-L}$, and $C_{R-L}$ from equations (11) and (12) and summed to produce right and left inputs for the videoconferencing system. For example, to form the right stereo input, the input from cardioid 52A is weighted by $A_R$=0.6667, the input from cardioid 52B is weighted by $B_R$=−0.3333, and the input from cardioid 52C is weighted by $C_R$=0.6667. These weighted inputs are then summed together to form the right stereo input. A similar process is used to form the left stereo input.

The weighting variables $A_{R-L}$, $B_{R-L}$, and $C_{R-L}$ discussed above assume that the phases of sound arriving at the three microphones 52A-C are each the same. In practice and as shown in FIG. 3B, the microphones 52A-C are separated by a distance D, so that the phases of sound arriving at each microphone 52A-C are not the same in reality. If the distance D separating the microphones 52A-C is less than 1/16 of a wavelength of the input sound, the differences in the phases are small enough that the right and left stereo input may be sufficiently produced.

Preferably, the microphones 52A-C in the audio unit 50 are 5-mm (thick) by 10-mm (diameter) cardioid microphone capsules. In addition, the microphones 52A-C are preferably spaced apart by the distance D of approximately 10-mm from center to center of one another, as shown in FIG. 3B. With the spacing D of 10-mm, the directive patterns for the right and left stereo input may be accurate up to about a 2-kHz wavelength of sound. Above this frequency, the directive patterns of the right and left stereo inputs may deviate from what is ideal in that nulls in the directive patterns may not be as deep as desired. In some recording or conferencing applications, however, preserving nulls in the directive patterns at the higher frequencies may be less important.

Although the audio unit 50 discussed above has been specifically directed to three cardioid microphones 52A-C, this is not necessary. Equations (2) through (9) and the inversion of the matrix in (9) can be applied generally to any type (i.e., cardioid, hypercardioid, dipole, etc.) of first-order microphones that are oriented at arbitrary angles and not necessarily applied just to cardioid microphones as in the above examples. As long as the resultant 3×3 matrix in equation (9) can be inverted, the same principles discussed above can be applied to three microphones of any type to produce an arbitrarily-rotated, first-order microphone pattern for stereo operation as well. Moreover, by weighing the signal inputs of the microphones 52A-C for arbitrary microphone patterns and angles of rotation, the disclosed audio unit 50 can be used not only in videoconferencing but also in a number of implementations for stereo operation.

As has already been discussed with respect to FIG. 2, the audio unit 50 can be arbitrarily oriented relative to sound sources and to the videoconferencing system 100. Before conducting a videoconference, the control unit 102 should first determine the arbitrary orientation of the audio unit 50 so that the stereo input to the system 100 will correspond to the orientation of the videoconferencing system 100 (i.e., the right field of view of the camera 108 will correspond to the right stereo input of the audio unit 50.) Preferably, the control unit 102 also continually or repeatedly determines the orientation of the audio unit 50 during the videoconference in the event that the audio unit 50 is moved or turned.

Once the audio unit's orientation is determined, the microphones 52A-C in their arbitrary position are used to pickup audio for the videoconference and send their signal inputs to the control unit 102. In turn, the control unit 102 processes the signal inputs from the three microphones 52A-C with the techniques disclosed herein and produces right and left stereo inputs for the videoconferencing system 100.

Figure 5:
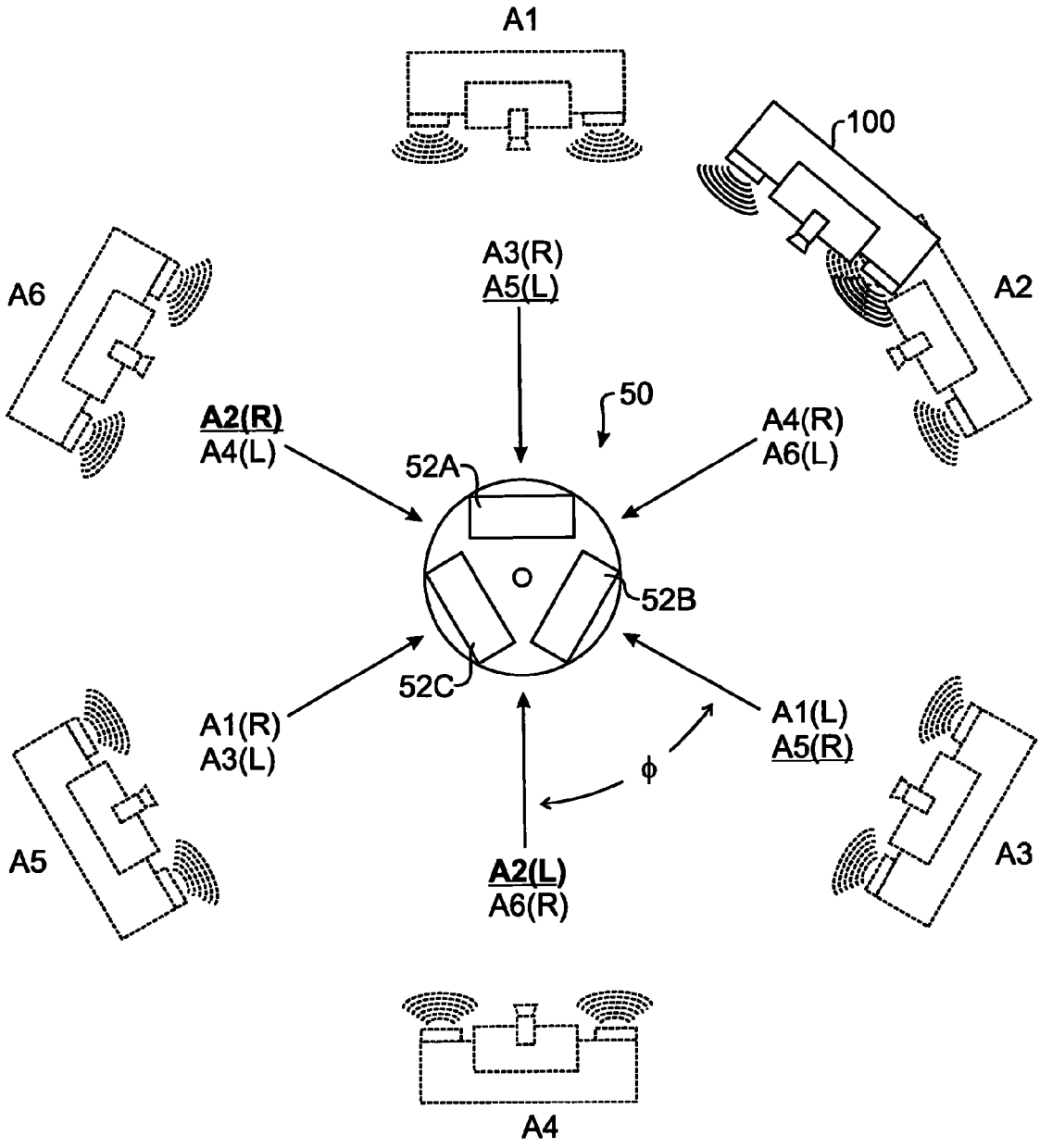
FIG. 5 illustrates a plurality of preconfigured arrangements for the disclosed audio unit relative to an audio system.

In one embodiment, the control unit 102 stores weighting variables for preconfigured arrangements of the cluster of microphones 52A-C relative to the videoconferencing system 100. Preferably, six or more preconfigured arrangements are stored. For example, FIG. 5 schematically shows six preconfigured arrangements A1 through A6 for six positions of the cluster of microphones 52A-C relative to the videoconferencing system 100. For each arrangement A1 through A6, the directive patterns are shown as arrows and are labeled which directive is for left or right stereo input. For example, the preconfigured arrangement A1 corresponds to the videoconferencing system being in position at A1 and being inline with microphone 52A of the audio unit 50. The right and left directive patterns A1(R) and A1(L) for this arrangement A1 are directed at either side of the audio unit 50 and are angled at 120-degrees away from the videoconferencing system positioned at A1.

Each of the arrangements A1 through A6 has pre-calculated weighting variables $A_{R-L}$, $B_{R-L}$, and $C_{R-L}$, which are applied to signal inputs of the corresponding microphones 52A-C to produce the stereo inputs depicted by the directive patterns for the arrangements. Because the cluster of microphones 52A-C can be arbitrarily oriented relative the actual location of the videoconferencing system 100, at least one of these preconfigured arrangements A1 through A6 will approximate the desired directive patterns of stereo input for the actual location of the videoconferencing system 100. For example, FIG. 5 shows that arrangement A2 having directive patterns A2(R) and A2(L) would best correspond to the actual location of the videoconferencing system 100.

Figure 6:
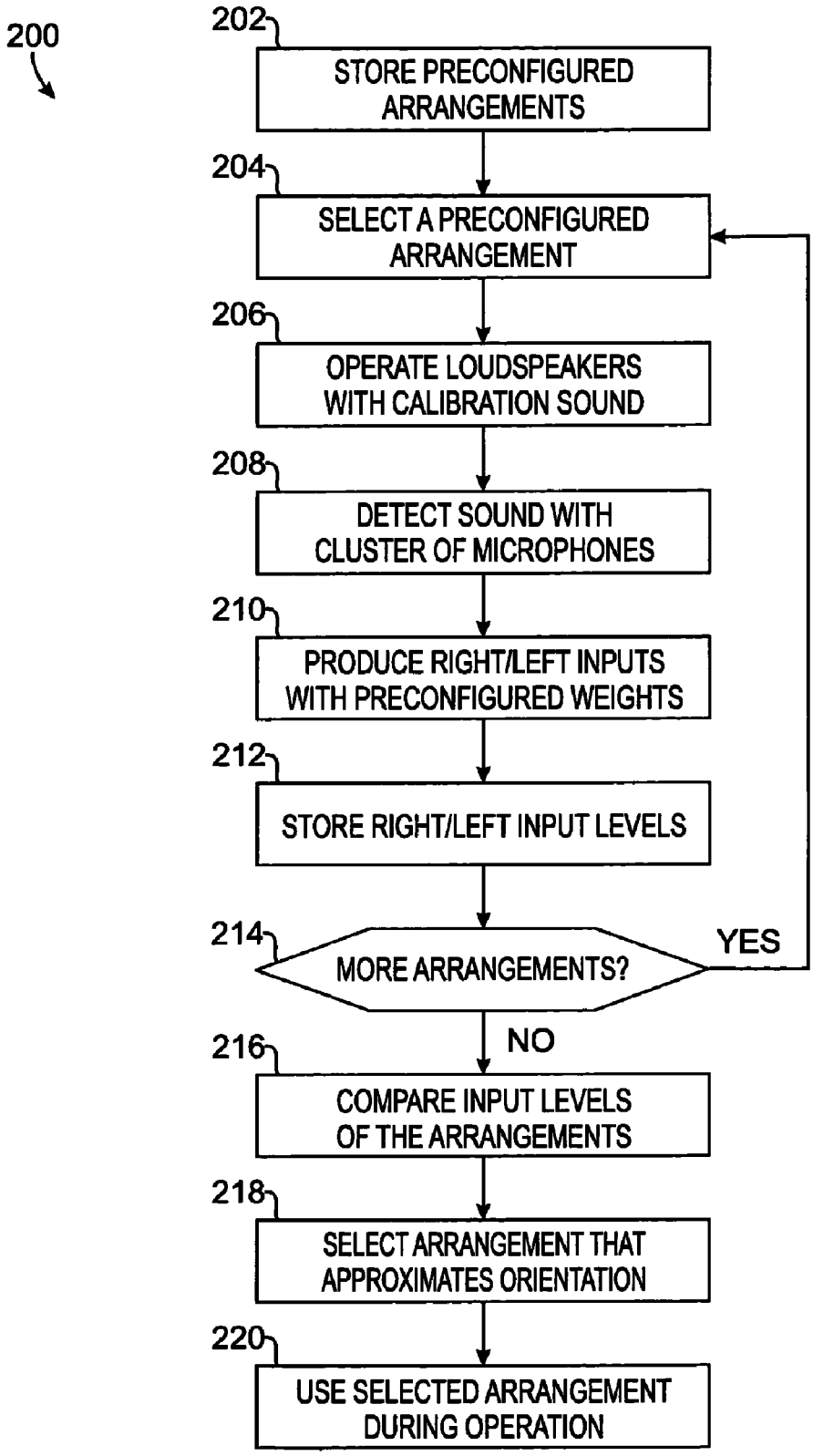
FIG. 6 illustrates a sequence for calibrating the disclosed audio unit using preconfigured arrangements.

A calibration sequence using such preconfigured arrangements is shown in FIG. 6 to determine the orientation of the audio unit 50 relative to the videoconferencing system 100. The control unit 102 stores the plurality of preconfigured arrangements representing possible orientations of the audio unit 50 relative to the videoconferencing system 100 (Block 202). The control unit 102 then selects one of those arrangements (Block 204) and emits one or more calibration sounds or tones from one or both of the loudspeakers 106 (Block 206).

The calibration sound(s) can be a predetermined tone having a substantially constant amplitude and wavelength. Moreover, the calibration sound(s) can be emitted from one or both loudspeakers. In addition, the calibration sound(s) can be emitted from one and then the other loudspeaker so that the control unit 102 can separately determine levels for right and left stereo input of the preconfigured arrangements. The calibration sounds(s), however, need not be predetermined tones. Instead, the calibration sound(s) can include the sound, such as speech, regularly emitted by the loudspeakers during the videoconference. Because the control unit 102 controls the audio of the conference, it can correlate the emitted sound energies from the loudspeakers 106R-L with the detected energy from the microphones 52A-C during the conference.

In any of these cases, the microphones 52A-C detect the emitted sound energy, and the control unit 102 obtains the signal inputs from each of the three microphones 52A-C (Block 208). The control unit 102 then produces the right/left stereo inputs by weighting the signal inputs with the stored weighting variables for the currently selected arrangement (Block 210). Finally, the control unit 102 determines and stores levels (e.g., average magnitude, peak magnitude) of those right/left stereo inputs, using techniques known in the art (Blocks 212).

After storing the levels for the first selected arrangement, the control unit 102 repeats the acts of Blocks 204 to 214 for each of the stored arrangements. Then, the control unit 102 compares the stored levels of each of the arrangements relative to one another (Block 216). The arrangement producing the greatest input levels in comparison to the other arrangements is then used to determine the arrangement that best corresponds to the actual right and left orientation of the cluster of microphones 52A-C relative to the videoconferencing system 100. The control unit 102 selects the preconfigured arrangement that best corresponds to the orientation (Block 218) and uses that preconfigured arrangement during operation of the videoconferencing system 100 (Block 220).

As an example, FIG. 5 shows that directive patterns A5(R) and A5(L) will produce the best input levels during the calibration tone because both directive patterns A5(R) and A5(L) are directed approximately 60-degrees relative to the loudspeakers of the videoconferencing system 100, which is shown in its actual location by solid lines in FIG. 5. Instead of selecting arrangement A5 of directive patterns A5(R) and A5(L), however, the control unit selects the inverse arrangement A2 having directive patterns A2(R) and A2(L), which will be actually used during stereo operation of the videoconferencing system 100. This is because these directive patterns A2(R) and A2(L are directed towards potential audio sources of the conference instead of being directed at the videoconferencing system 100. The pre-calculated weightings $A_{R-L}$, $B_{R-L}$, and $C_{R-L}$ for this arrangement A2 can then be applied to signal inputs from the microphones 52A-C such that they produce the right and left stereo input with the desired directive patterns A2(R) and A2(L).

Rather than storing preconfigured arrangements for a calibration sequence, the control unit 102 can use a detection sequence to determine the orientation of the unit 50 directly. In the detection sequence, the videoconferencing system 100 emits one or more sounds or tones from one or both of the loudspeakers 104. Again, the sounds or tones during the detection sequence can be predetermined tones, and the detection sequence can be performed before the start of the conference. Preferably, however, the detection sequence uses the sound energy resulting from speech emitted from the loudspeakers 106L-R while the conference is ongoing, and the sequence is preferably performed continually or repeatedly during the ongoing conference in the event the microphone cluster is moved.

The microphones 52A-C detect the sound energy, and the control unit 102 obtains the signal inputs from each of the three microphones 52A-C. The control unit 102 then compares the signal input for differences in characteristics (e.g., levels, magnitudes, and/or arrival times) of the signal inputs of the microphones 52A-C relative to one another. From the differences, the control unit 102 directly determines the orientation of the audio unit 50 relative to the videoconferencing system 100.

For example, the control unit 102 can compare the ratio of input levels or magnitudes at each of the microphones 52A-C. At some frequencies of the emitted sound, comparing input magnitudes may be problematic. Therefore, it is preferred that the comparison use the direct energy emitted from the loudspeakers 106 and detected by the microphones 52A-C.

Unfortunately, at some frequencies, increased levels of reverberated energy may be detected at the microphones 52A-C and may interfere with the direct energy detected from the loudspeakers. Therefore, it is preferred that the control unit 102 compare peak energy levels detected at each of the microphones 52A-C because the peak energy will generally occur during the initial detection at the microphone 52A-C where reverberation of the emitted sound energy is less likely to have occurred yet.

For example, assume that the peak levels from the microphones can range from zero to ten. If the peak levels of microphones 52A and 52B are both about seven and the level of microphone 52C is one, for example, then the sound source (i.e., the videoconferencing system 100 in the detection sequence) would be approximately in line with a point between the microphones 52A and 52B. Thus, from the comparison, the control unit 102 determines the orientation of the cluster of microphones 52A-C by determining which one or more microphones are (at least approximately) in-line with the videoconferencing system 100.

Figure 7A:
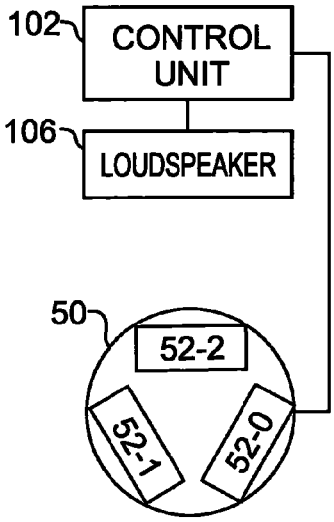
FIG. 7A illustrates a unit relative to a loudspeaker and a control unit.

To illustrate how the control unit 102 can determine the orientation of a unit 50, we turn to FIG. 7A, which shows a unit 50 according to the present disclosure having three microphones 52-0, 52-1, and 52-2 in a cluster. The unit 50 is shown relative to a loudspeaker 106, which the control unit 102 uses to emit tones or sounds. The control unit 102 determines the rotation of the unit 50 relative to the loudspeaker 106 so that the microphones 52 can be operated appropriately for stereo pick-up. For example, the control unit 102 can determine that microphone 52-2 is pointed at the loudspeaker 106 and that microphones 52-0 and 52-1 are pointed away from the loudspeaker 106. Based on that determination, the control unit 102 can select microphone 52-0 for the left audio channel and 52-1 for the right audio channel for stereo pick-up. For other orientations, the control unit 102 can take appropriately weighted sums of the microphone signals to form left and right audio beams.

The control unit 102 uses the loudspeaker 106 to emit sounds or tones to be detected by the microphones 52 of the unit 50. When the loudspeaker 106 emits sound, the relative difference in energy between the microphones 52-0, 52-1, and 52-2 can be used to determine the orientation of the unit 50. In an environment with no acoustic reflections, a cardioid microphone (e.g., 52-2) pointed at the loudspeaker 106 will have about 6-decibels more energy than a cardioid microphone pointed 90-degrees away from the loudspeaker 106 and will have (typically) 15-decibels more energy than a cardioid microphone pointed 180-degrees away from the loudspeaker 106. Unfortunately, room reflections tend to even out these energy differences to some extent so that a straightforward measurement of energies may yield inaccurate results.

Figure 7B:
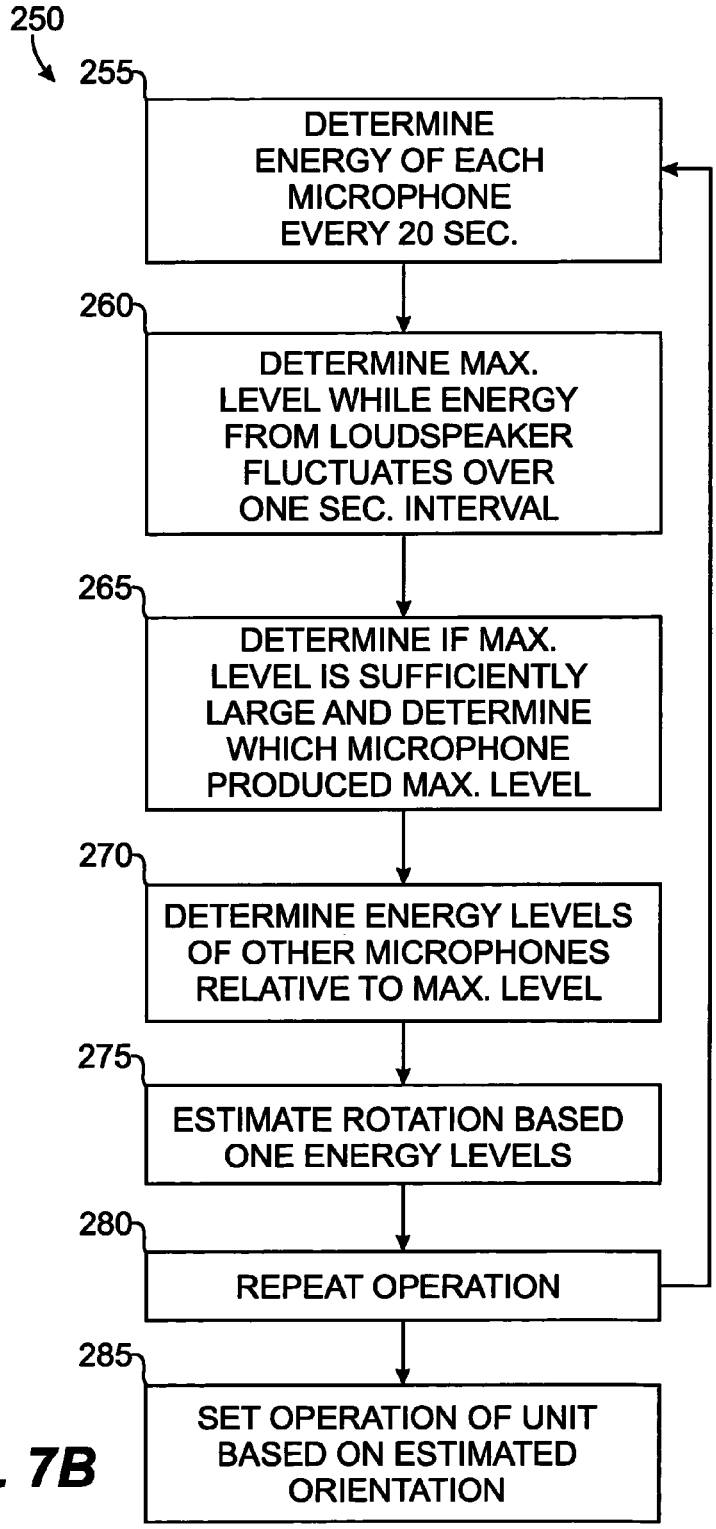
FIG. 7B illustrates an algorithm for determining the orientation of a unit relative to a loudspeaker.

In FIG. 7B, an algorithm 250 for determining the orientation of the unit 50 is illustrated. This algorithm 250 attempts to minimize the influence of room reflections by searching for energy peaks over time. During the energy peaks, the influence of room reflections can be minimized. Additionally, lower frequencies have stronger room reflections than higher frequencies. However, if the frequency is too high, the cardioid microphone loses its directionality. Thus, the algorithm 250 also preferably uses a frequency range that is more conducive to energy measurement.

In the algorithm 250, it is assumed that the three microphones 52-0, 52-1, and 52-2 are unidirectional, cardioid microphones. As stage 255, the control unit (102) determines the energy for each of the three microphones (52) every 20 milliseconds. The energy for the microphones (52) is preferably determined in the frequency region 1-kHz to 2.5-kHz and can be represented by Energy[i][t], where [i] represent an index (0, 1, 2) of the microphones (52) and where [t] designates the time index. At stage 260, the emitted energy from the loudspeaker (106) will fluctuate over a one-second interval. In this time interval, the control unit (102) determines the value of [t] for which Energy[i][t] is at a maximum value. At stage 265, the control unit (102) determines whether the maximum value determined at stage 260 is sufficiently large enough such that it is not produced just by noise. This determination can be made by comparing the maximum value to a threshold level, for example. If this maximum value is sufficiently large, then the control unit (102) determines the index i of the microphone (52) that has yielded the maximum value for Energy[i][t] at the value of [t] found in stage 260 above. At stage 270, for the two other microphones (52), the control unit (102) determines the energy in decibels (dB) relative to the maximum energy value. Typically, for the loudspeaker-microphone configuration pictured in FIG. 7A, the in-line microphone (52-2) would yield the maximum energy value, and both of the other microphones (52-1 and 52-0) would have energies that are about 6-dB below that of the in-line microphone (52-2). In other configurations where the unit (50) is rotated from the orientation shown in FIG. 7A, one of the other microphones (52-1 or 52-0) would have an energy level slightly higher than the other.

At stage 275, the control unit (102) estimates the rotation of the unit (50) relative to the loudspeaker (106) based on the relative energies between the microphones (52). At stage 280, the control unit (102) repeats the operations in stages 255 through 275 for the next one second segment of time, so that a new estimate of rotation is determined if the energy is sufficiently above the level of noise. If a number of consecutive measurements made in the manner above (e.g., three loops through stages 255 through 275) yields identical rotation estimates, the control unit (102) assumes that this rotation estimate is accurate and sets operation of the unit (50) based on the estimated rotation at stage 285.

Figure 8:
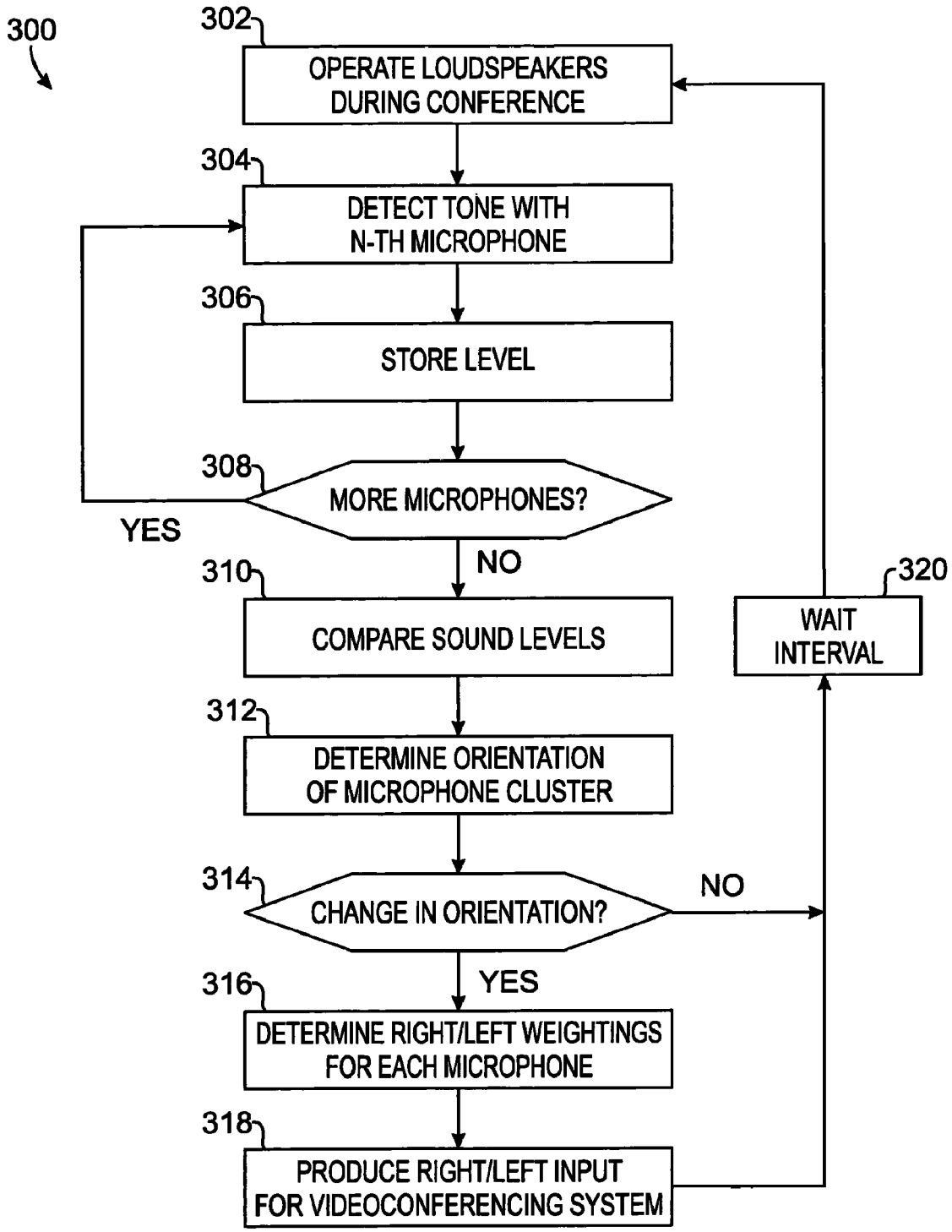
FIG. 8 illustrates a sequence for determining the orientation of the disclosed audio unit when arbitrary positioned relative to a videoconferencing system.

In FIG. 8, a detection sequence 300 for a videoconference is shown. First, the videoconferencing system 100 operates as usual during the conference and emits sound from the speakers (Block 302). Again, the sounds can be predetermined but are preferably sounds, such as speech, emitted during the course of the videoconference. During the emitted sound, the control unit 102 queries one of the microphones (e.g., 52A) of the audio unit 50 (Block 304) and stores the level of input energy of that microphone 52A (Block 306). This detection and storage of the input signals from emitted sound is performed for all three microphones 52A-C, and the input signals for each microphone 52A-C are stored (Blocks 304 through 308).

Detection and storage of the input signals in Blocks 304 through 308 can be performed sequentially but is preferably performed simultaneously for all the microphones 52A-C at once during the emitted sound. In one alternative, the control unit 102 can obtain the arrival times of the emitted sound at the various microphones 52A-C and store those arrival times instead of or in addition to storing the levels of input energy.

When the control unit 102 has the levels (e.g., average or peak magnitudes) of signal inputs and/or arrival times of the signal inputs for all the microphones 52A-C, the control unit 102 compares those levels and/or arrival times with one another (Block 310). From the comparison, the control unit 102 determines the orientation of the microphones 52A-C relative to the videoconferencing system 100 (Block 312) and determines whether the orientation has changed since the previous orientation determined for the cluster (Block 314).

Preferably, the technique and algorithm discussed above with reference to FIGS. 7A-7B are used to find the orientation of the microphones 52A-C. If the orientation has not changed, the sequence waits for a predetermined interval at Block 320 before restarting the sequence 300.

If the orientation of the cluster has changed (e.g., a participant has moved the cluster during the conference since the last time the orientation has been determined), the sequence 300 determines the right and left weightings for each of the microphones. The orientation determined above provides the angle $\phi$ (phi) for equation (10), which is then solved using processing hardware and software of the control unit 102 and/or the audio unit 50. From the calculations, both right and left weighting variables $A_{R-L}$, $B_{R-L}$, and $C_{R-L}$ are determined for the microphones 52A-C in the manner discussed previously in conjunction with equations (11) and (12) (Block 316).

Now that the weighting variables $A_{R-L}$, $B_{R-L}$, and $C_{R-L}$ have been determined, the audio unit 50 can be used for stereo operation. As discussed in more detail previously, the signal inputs of each of the three microphones 52A-C are multiplied by the corresponding variables $A_R$, $B_R$, and $C_R$, and the weighted inputs are then summed together to produce a right input for the videoconferencing system 100. Similarly, the signal inputs of each of the three microphones 52A-C are multiplied by the corresponding variables $A_L$, $B_L$, and $C_L$, and the weighted inputs are summed together to produce a left input for the videoconferencing system 100 (Block 318).

The detection sequence 300 of FIG. 8 can be performed when a videoconference is started. Preferably, the sequence 300 is performed periodically or continually during the videoconference in the event the audio unit 50 is moved. Processing hardware and software of the control unit 102 preferably performs the procedures of the detection sequence 300 (and the calibration sequence 200 of FIG. 6 discussed previously). Furthermore, during operation, the microphones 52A-C preferably operate in a conventional manner obtaining signal inputs, which are sent to the control unit 102. Then, processing hardware and software of the control unit 102 preferably performs the procedures associated with determining orientation and weighting/summing the signal inputs to produce stereo input for the videoconferencing system 100. In an alternative, the audio unit 50 can have processing hardware and software that performs some or all of these processing procedures.

Figure 9:
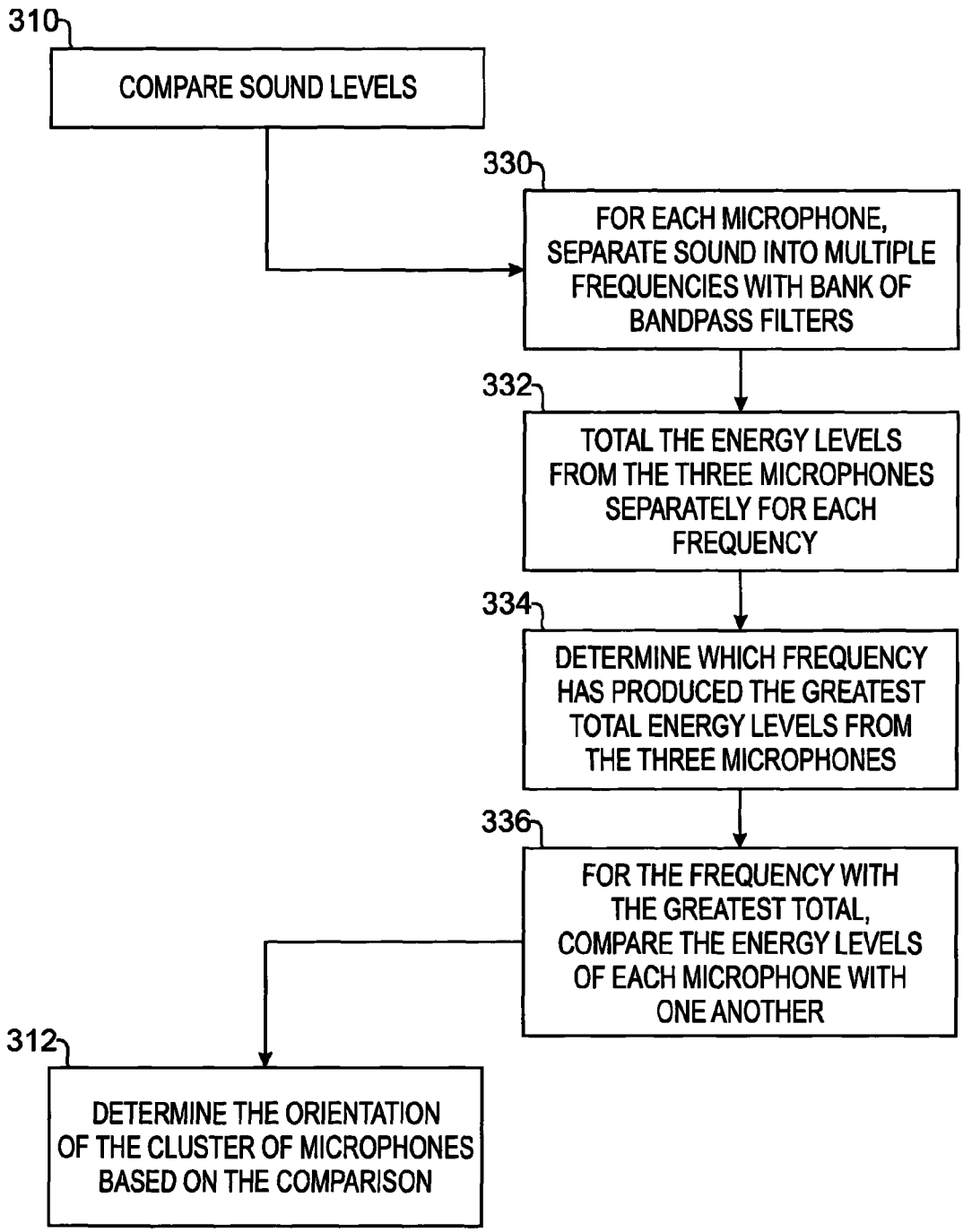
FIG. 9 illustrates a sequence for comparing sound levels detected with the microphones to determine the orientation of the microphone cluster.

As noted above, processing hardware and software compare the sound levels detected with the microphones in Block 310 before determining the orientation of the cluster in Block 312 of the detection sequence 300. Referring to FIG. 9, an embodiment of a sequence for comparing sound levels is illustrated to determine the orientation of the microphone cluster. For each microphone, the detected sound energy is separated into multiple frequencies by a bank of bandpass filters (Block 330). Preferably, the sound energy is separated into about eight frequencies so that substantially direct sound energy detected at the microphones can be separated from sound energy that has been reverberated or reflected.

For each of these separate frequencies, the total energy levels from the three microphones are totaled together (Block 332). Each total of the energy levels essentially is a vote for which separate frequency of the emitted sound has produced the most direct detected energy levels at the microphones. Next, the total energy levels for each frequency are compared to one another to determine which frequency has produced the greatest total energy levels from all three microphones (Block 334). For this frequency with the greatest levels, the separate energy levels for each of the three microphones are compared to one another (Block 336). Ultimately, the orientation of the cluster of microphones relative to the videoconferencing system is based on that comparison (Block 312) and the sequence proceeds as described previously.

Figure 10:
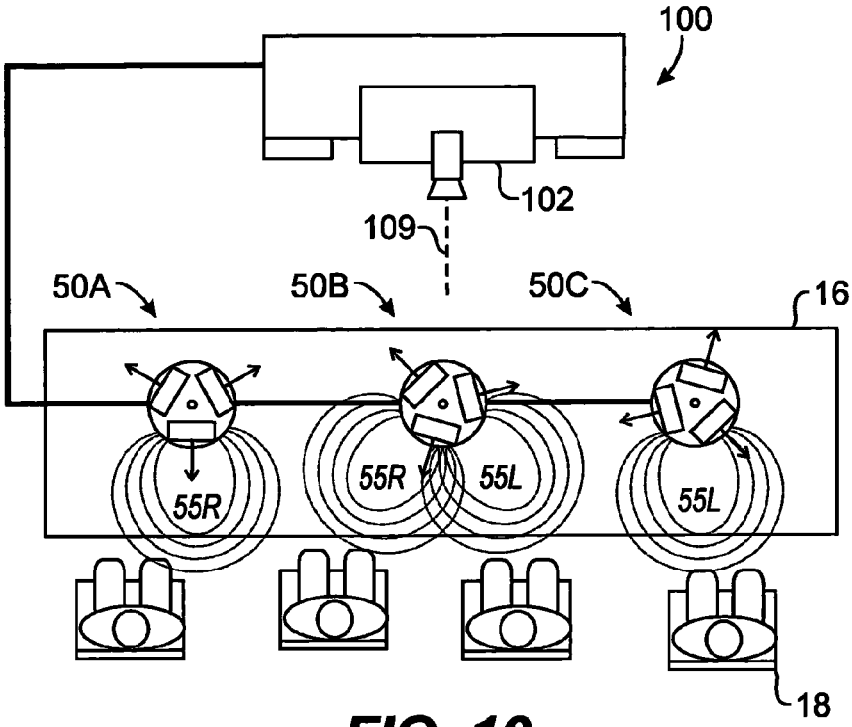
FIG. 10 illustrates a videoconferencing system having a plurality of microphone clusters in a broadside arrangement.
Figure 11:
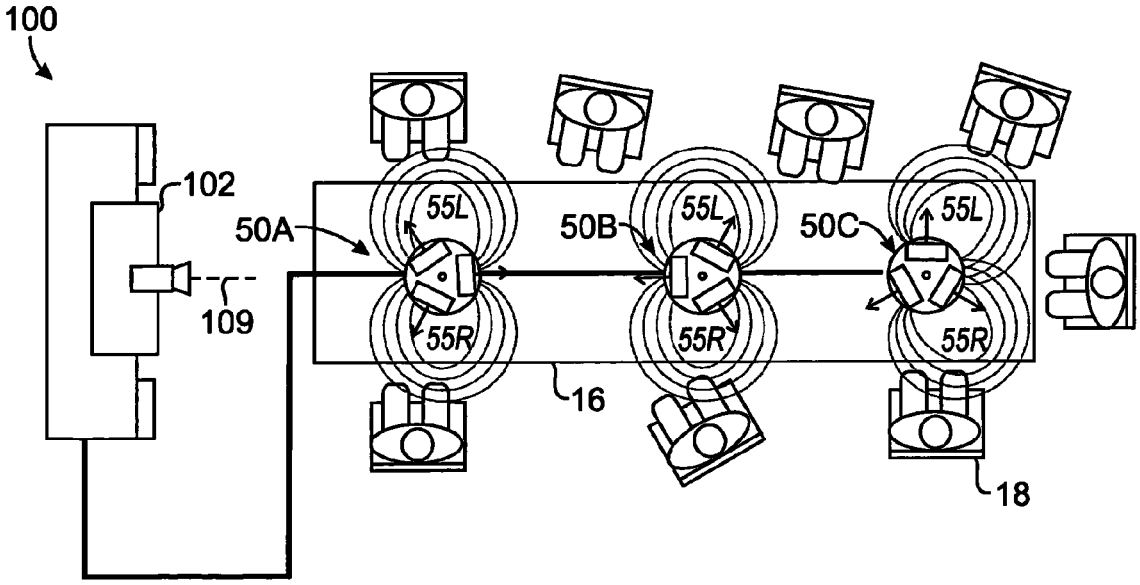
FIG. 11 illustrates a videoconferencing system having a plurality of microphone clusters in an endfire arrangement.

In the previous discussion, the videoconferencing systems have been shown with only one audio unit 50. However, more than one audio unit 50 can be used with the videoconferencing systems depending on the size of the room and the number of participants for the videoconference. For example, FIG. 10 illustrates three audio units 50A-C in a broadside arrangement relative to the videoconferencing system 100, while FIG. 11 illustrates three audio units 50A-C in an endfire arrangement relative to the videoconferencing system 100. Although only three audio units 50A-C are shown in FIGS. 10 and 11, it will be appreciated that the videoconferencing system 100 can use two or more audio units 50 in either the broadside or the endfire arrangements.

In the broadside arrangement of FIG. 10, the audio units 50A-C are arranged substantially orthogonal to the view angle 109 of the videoconferencing system 100, and the participants 18 are mainly positioned on an opposite side of the table 16 from the videoconferencing system 100. In this broadside arrangement, one audio unit 50A is positioned on the right side, one audio unit 50C is positioned on the left side, and another audio unit 50B is positioned at about the center at the view angle 109. The cluster of microphones in the audio units 50A-C may be arbitrarily oriented. Thus, when setting up the audio units 50A-C, the participants need only to arrange the units 50A-C in a line without regard to how the units 50A-C are turned.

The control unit 102 and the three audio units 50A-C operate in substantially the same ways as described previously. However, the participants configure the control unit 102 to operate the audio units 50A-C in a broadside mode of stereo operation. The control unit 102 then determines the orientation of the audio units 50A-C (i.e., how each is turned or rotated relative to the videoconferencing system 100) using the techniques disclosed herein. From the determined orientations, the control unit 102 performs the various calculations and weightings for the right and left audio units 50A and 50C respectively to produce at least one directive pattern 55$A_R$ for right stereo input and at least one directive pattern 55$C_L$ for left stereo input. In addition, the control unit 102 performs the calculations and weightings detailed previously for the central audio unit 50B to produce directive patterns 55$B_{R-L}$ for both right and left stereo input. As before, calibration and detection sequences can be used to determine and monitor the orientation of each audio unit 50A-C before and during the videoconference.

In the endfire arrangement of FIG. 11, the audio units 50A-C are arranged substantially parallel to the view angle 109 of the videoconferencing system 100, and the participants 18 are mainly positioned on an opposite sides of the table 16 with some participants 18 possibly seated at the far end of the table. Again, the cluster of microphones in the audio units 50A-C may be arbitrarily oriented so that the participants need only to arrange the units 50A-C in a line without regard to how the audio units 50A-C are rotated when setting up the units.

The control unit 102 and the three audio units 50A-C operate in substantially the same ways as described previously. However, the participants configure the control unit 102 to operate the audio units 50A-C in an endfire mode of stereo operation. The control unit 102 determines the orientation of the audio units 50A-C (i.e., how each is turned or rotated relative to the videoconferencing system 100) using the techniques disclosed herein. From the determined orientations, performs the various calculations and weightings for each of the audio units 50A-C to produce right and left directive patterns 55$A_{R-L}$ for right and left stereo input. As before, calibration and detection sequences can be used to determine and monitor the orientation of each audio unit 50A-C before and during the videoconference 100. As shown, it may be preferred that the directive pattern 55$A_{R-L}$ for the end audio unit 50C be angled outward toward possible participants 18 seated at the end of the table 16, while the directive patterns 55$A_{R-L}$ of the other audio units 50A-B may be directed at substantially right angles to the endfire arrangement.

The foregoing description of preferred and other embodiments is not intended to limit or restrict the scope or applicability of the inventive concepts conceived of by the Applicants. For example, although the present disclosure focuses on using first order microphones, it will be appreciated that teachings of the present disclosure can be applied to other types of microphones, such as N-th order microphones where N≧1. Moreover, even though the present disclosure has focused on two channel inputs (i.e., stereo input) for an audio system, it will be appreciated that teachings of the present disclosure can be applied to audio systems having two or more channel inputs. Thus, in exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. A method of operating a cluster of at least three microphones for at least two channel inputs of an audio system, each of the microphones being an $N^{th}$-order microphone where N≧1, the cluster being positionable in an arbitrary orientation relative to the audio system, the method comprising:

storing a plurality of stored orientations for the cluster;

processing calibration signal inputs received from each of the microphones in response to audio emitted with the audio system by using each of the stored orientations;

comparing each of the processed calibration signal inputs with each other;

automatically determining the arbitrary orientation of the cluster with respect to the audio system by selecting one of the stored orientations based on the comparison;

determining first and second weightings to be applied to operational signal input generated by each microphone, the first weightings corresponding to the determined arbitrary orientation relative to a first of the at least two channel inputs of the audio system;

the second weightings corresponding to the determined arbitrary orientation relative to a second of the at least two channel inputs of the audio system;

producing first channel input for the audio system by:

weighting the operational signal input generated by each microphone by its corresponding first weighting, and combining the first weighted signal inputs of the microphones; and producing second channel input for the audio system by:

weighting the operational signal input generated by each microphone by its corresponding second weighting, and combining the second weighted signal inputs of the microphones.

2. The method of claim 1, wherein each of the microphones comprises a first-order microphone having a cardioid, a hypercardioid, or a dipole directive pattern.

3. The method of claim 1, wherein the cluster of microphones comprises three microphones positioned substantially on a plane and positioned radially around a center of the cluster at about every 120-degrees from one another.

4. The method of claim 1, wherein the audio system is selected from the group consisting of a videoconferencing system, a multi-channel audio conferencing system, and a recording system.

5. The method of claim 1, wherein the at least two channel inputs for the audio system comprise right and left stereo inputs for the audio system.

6. The method of claim 1, further comprising a conference phone having the cluster of at least three microphones.

7. The method of claim 1, wherein comparing each of the processed calibration signal inputs with each other comprises comparing differences in magnitudes of the processed calibration signal inputs.

8. The method of claim 7, wherein comparing differences in magnitudes of the processed calibration signal inputs comprises comparing the differences in magnitudes over a plurality of time intervals.

9. The method of claim 1, wherein comparing each of the processed calibration signal inputs with each other comprises comparing differences in arrival times of the processed calibration signal inputs.

10. The method of 1, wherein processing the processed calibration signal inputs using each of the stored orientations comprises:

weighting the processed calibration signal inputs using weightings for each microphone, the weightings associated with each of the stored orientations relative to the at least two channel inputs of the audio system, and combining the weighted calibration signal inputs for a stored orientation to produce the processed calibration signal input for that stored orientation.

11. The method of claim 1, further comprising operating a plurality of the audio units for stereo operation in either an endfire or a broadside orientation relative to the audio system.

12. An audio system, comprising:

an audio unit comprising at least three microphones, each of the microphones being an Nth-order microphone where N≧1, the audio unit being arbitrarily oriented with respect to the audio system; and a control unit coupled to the audio unit and configured to:

store a plurality of stored orientations for the audio unit;

use each of the stored orientations to process calibration signal inputs received from each of the microphones in response to audio emitted with the audio system;

compare each of the processed calibration signal inputs with each other;

select one of the stored orientations based on the comparison to automatically determine the arbitrary orientation of the audio unit with respect to the audio system;

determine at least two channel weightings for each microphone as a function of the determined arbitrary orientation of the audio unit, combine, for each of the at least two channels, the corresponding determined weighting applied to operational signal input generated by each microphone, and generate at least two channel input signals for the audio system using the corresponding combined operational signal inputs.

13. The audio system of claim 12, where the audio system is selected from the group consisting of a videoconferencing system, a multi-channel audio conferencing system, and a recording system.

14. The audio system of claim 12, further comprising a conference phone having the audio unit.

15. The audio system of claim 12, wherein the at least two channel input signals for the audio system comprise right and left stereo input signals for the audio system.

16. The audio system of claim 12, wherein each of the microphones comprises a first-order microphone having a cardioid, a hypercardioid, or a dipole directive pattern.

17. The audio system of claim 12, wherein the audio unit comprises a cluster of three microphones arranged at approximately 120-degrees around a center of the audio unit.

18. The audio system of claim 17, wherein each of the three microphones comprises a microphone capsule being about 5-mm by 10-mm in dimension and being spaced apart approximately 10-mm from center to center of one another.

19. The audio system of claim 12, wherein to combine and generate the at least two channel input signals for the audio system, the control unit is configured to:

weight the calibration signal input generated by each of the microphones by its corresponding channel weightings, and combine the weighted calibration signal inputs of a channel to produce the channel input for the audio system for that channel.

20. The audio system of claim 12, wherein to compare the processed calibration signal inputs with each other, the control unit is operable to compare differences in magnitudes between the processed calibration signal inputs.

21. The audio system of claim 20, wherein to compare differences in magnitudes between the processed calibration signal inputs, the control unit is operable to compare the differences in magnitudes over a plurality of time intervals.

22. The audio system of claim 12, wherein to compare the processed calibration signal inputs with each other, the control unit is operable to compare differences in arrival times between the processed calibration signal inputs.

23. The audio system of 12, wherein to process the calibration signal inputs using each of the stored orientations, the control unit is operable to:

weight the calibration signal inputs using multi-channel weightings for each microphone, the multi-channel weightings associated with each of the stored orientations relative to the at least two channel inputs of the audio system, and combine the weighted calibration signal inputs for a stored orientation to produce the processed calibration signal input for that stored orientation.

24. The audio system of claim 12, further comprising at least one additional audio unit coupled to the audio unit, wherein the control unit is configured to operate the audio units for stereo operation in either an endfire or a broadside orientation relative to the audio system.

* * * * *